US009642511B2

(12) United States Patent
Shoup et al.

(10) Patent No.: US 9,642,511 B2
(45) Date of Patent: May 9, 2017

(54) IN-SITU DOOR REMOVAL DEVICE IN A DISHWASHING APPLIANCE

(71) Applicant: General Electric Company, Schenectady, NY (US)

(72) Inventors: Cory Blaine Shoup, Louisville, KY (US); Justin Paul Mudd, Louisville, KY (US); Dale Eugene Anderson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 14/870,057

(22) Filed: Sep. 30, 2015

(65) Prior Publication Data

US 2017/0086645 A1 Mar. 30, 2017

(51) Int. Cl.

| | |
|---|---|
| ***A47L 15/42*** | (2006.01) |
| ***E05D 7/10*** | (2006.01) |
| ***A47L 15/23*** | (2006.01) |
| ***A47L 15/50*** | (2006.01) |

(52) U.S. Cl.

CPC ..... *A47L 15/4261* (2013.01); *A47L 15/23* (2013.01); *A47L 15/4221* (2013.01); *A47L 15/4225* (2013.01); *A47L 15/4246* (2013.01); *A47L 15/4251* (2013.01); *A47L 15/4259* (2013.01); *A47L 15/4293* (2013.01); *A47L 15/502* (2013.01); *A47L 15/507* (2013.01); *E05D 7/1066* (2013.01); *E05D 2007/1094* (2013.01)

(58) Field of Classification Search

CPC .. A47L 15/23; A47L 15/4221; A47L 15/4225; A47L 15/4246; A47L 15/4251; A47L 15/4259; A47L 15/4261; A47L 15/4293; A47L 15/502; A47L 15/507; E05D 7/1066

USPC ..... 312/228, 311, 319.1, 319.2; 134/56 D, 134/59

See application file for complete search history.

(56) References Cited

U.S. PATENT DOCUMENTS

| | | | | |
|---|---|---|---|---|
| 3,826,553 | A * | 7/1974 | Cushing | A47L 15/4246 312/229 |
| 4,441,770 | A * | 4/1984 | Brezosky | A47L 15/427 312/271 |
| 4,900,109 | A * | 2/1990 | Boston, Jr. | A47L 15/4265 312/204 |
| 2006/0032019 | A1* | 2/2006 | Kistner | E05D 11/1007 16/286 |
| 2008/0272678 | A1* | 11/2008 | Tynes | A47L 15/4261 312/319.4 |

(Continued)

FOREIGN PATENT DOCUMENTS

| | | | |
|---|---|---|---|
| EP | 2556782 | * | 2/2013 |
| EP | 2888985 | * | 7/2015 |

(Continued)

*Primary Examiner* — James O Hansen

(74) *Attorney, Agent, or Firm* — Dority & Manning, P.A.

(57) ABSTRACT

A dishwasher door hinge assembly and spring linkage device is disclosed that enables the spring linkage to be removed from the hinge while the door remains attached to the hinge assembly and to the appliance. This provides in-situ removal of the door from the appliance without requiring the unit to be removed from the cabinet. Both the hinge and the spring linkage have geometry that allow for separation while the appliance remains mounted in final installed state (in-situ).

19 Claims, 8 Drawing Sheets

(56) References Cited

U.S. PATENT DOCUMENTS

| | | | | |
|---|---|---|---|---|
| 2011/0187246 | A1* | 8/2011 | Shin | A47L 15/4261 312/228 |
| 2013/0063011 | A1* | 3/2013 | Kozinski | A47L 15/4261 312/319.2 |
| 2013/0193819 | A1* | 8/2013 | Kozinski | A47L 15/4261 312/228 |
| 2014/0375192 | A1* | 12/2014 | Haft | E05D 13/1207 312/319.2 |

FOREIGN PATENT DOCUMENTS

| | | | |
|---|---|---|---|
| JP | 20021743071 | A | 5/2002 |
| WO | WO 2009/153186 | * | 12/2009 |

* cited by examiner

IN-SITU DOOR REMOVAL DEVICE IN A DISHWASHING APPLIANCE

FIELD OF THE INVENTION

The subject matter of the present invention relates generally to a device for servicing dishwasher appliances and more specifically to a device for in-situ removal of the door from an installed dishwasher.

BACKGROUND OF THE INVENTION

Typically, removal of a dishwasher door requires the hinge arms to disconnect from the door while the hinges stay connected to the tub and spring system. To maintain proper door stiffness in relation to the hinge arms, the hinge arms must stay connected to the door during removal of the door. This requires removal of the entire dishwasher from the cabinet in order to access the spring linkage and remove the door. Removal of the entire dishwasher from the cabinet is undesirable because of e.g., the additional labor involved with removing and reinstalling the appliance in the cabinet and accidental damage to cabinets and floors.

One-piece hinge designs can lower material and labor cost in manufacturing and provide a more robust door hinge system over previous two-piece designs. However, certain one-piece hinges still require removal of the dishwashing appliance from the cabinet in order to remove the dishwasher door.

Accordingly, a need arises for an in-situ door removal device for dishwashing appliances that allows removal of the dishwasher door without requiring removal of the dishwasher from the cabinet.

BRIEF DESCRIPTION OF THE INVENTION

A dishwasher door hinge assembly and a spring linkage is disclosed that enables the spring linkage to be removed from the hinge while the door remains attached to the hinge system and to the appliance. This allows for in-situ removal of the door from the appliance without requiring the appliance to be removed from the cabinet, giving the benefit of reducing the time required to service the unit. Both the hinge and the spring linkage system have geometry that allow for their separation while the appliance remains mounted in final installed state—such characteristics being referred to herein as in-situ door removal.

In an exemplary dishwashing appliance embodiment, a cabinet defines a wash chamber for the receipt of articles for washing, the cabinet including a pair of opposing side walls, a top wall, and a rear wall. A tub is disposed inside the cabinet configured with a front opening for receipt of a door hinged at its bottom. The door has a pair of one-piece hinges disposed proximate the opposing side walls, each hinge defining a top edge, bottom edge, hinge distal end, and hinge proximal end, the hinge proximal end being removably coupled to the door, the hinge distal end defining an arched cutout extending upward from the bottom edge and terminating near the hinge distal end. Each hinge has a spring linkage including a clevis removably coupled to the cutout, the clevis defining a clevis proximal end and a clevis distal end, the clevis further including a pair of legs positioned on opposing sides of the hinge and extending from the clevis distal end towards the clevis proximal end. A clevis connecting pin is disposed between the pair of legs at the clevis distal end, each clevis leg further including at least one tool bore for complementary receipt of a linkage removal tool.

In another exemplary embodiment, a dishwashing appliance door hinge assembly is disclosed having a pair of one-piece hinges supported near the bottom of a dishwasher door, each hinge defining a top edge, bottom edge, hinge distal end, and hinge proximal end, the hinge proximal end removably coupled to the door, the hinge distal end defining an arched cutout extending upward from the bottom edge and terminating near the hinge distal end. The assembly also has at least one spring linkage, each spring linkage is attached to one of the hinges. Each spring linkage has a clevis removably coupled to the cutout, the clevis defining a clevis proximal end and a clevis distal end. The clevis has a pair of legs positioned on opposing sides of the hinge and extending from the clevis distal end towards the clevis proximal end. A clevis connecting pin is disposed between the pair of legs at the clevis distal end, each clevis leg having at least one tool bore configured for complementary receipt of a linkage removal tool.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
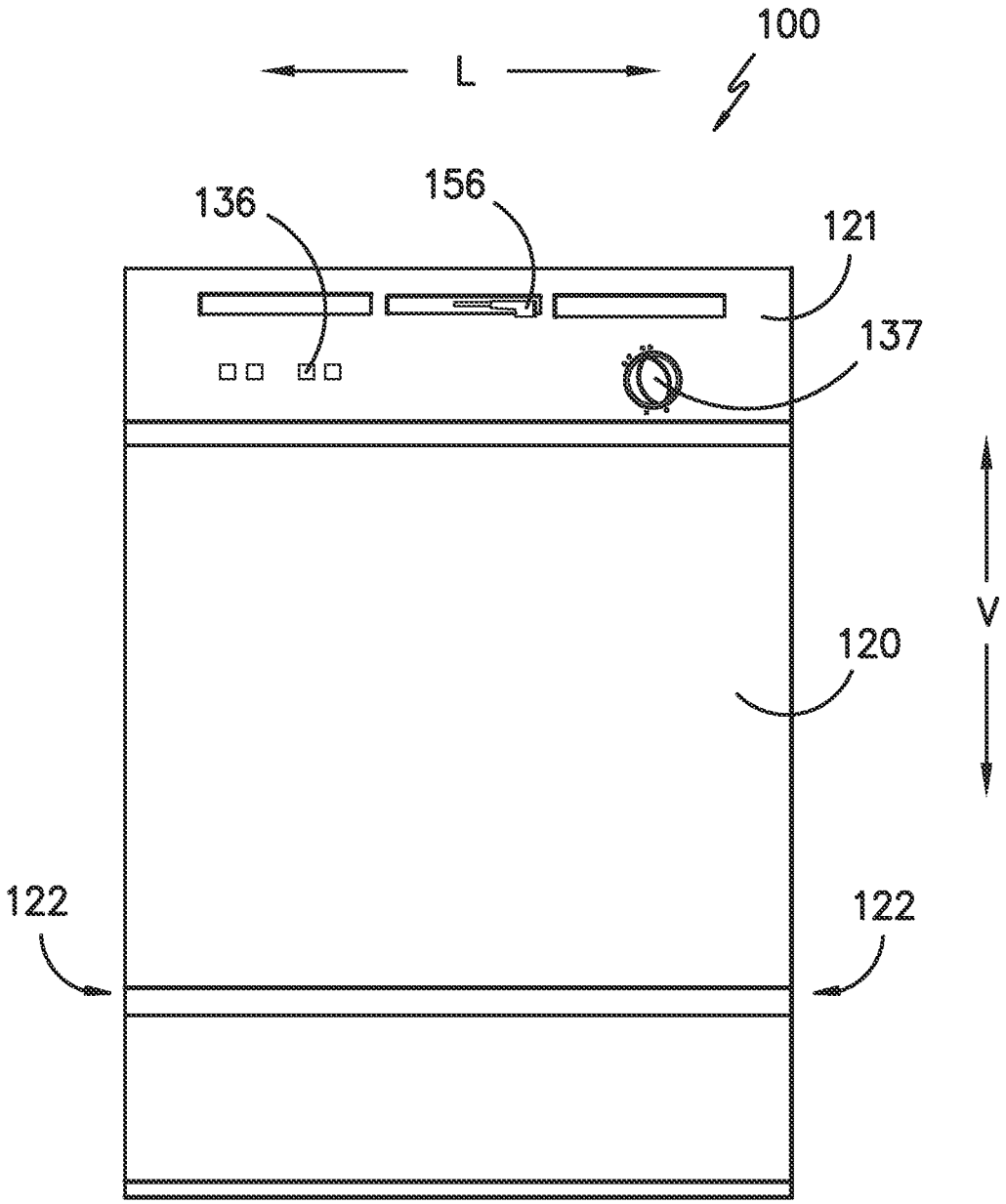
FIG. 1 provides a front view of an exemplary embodiment of a dishwashing appliance as may be used with the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
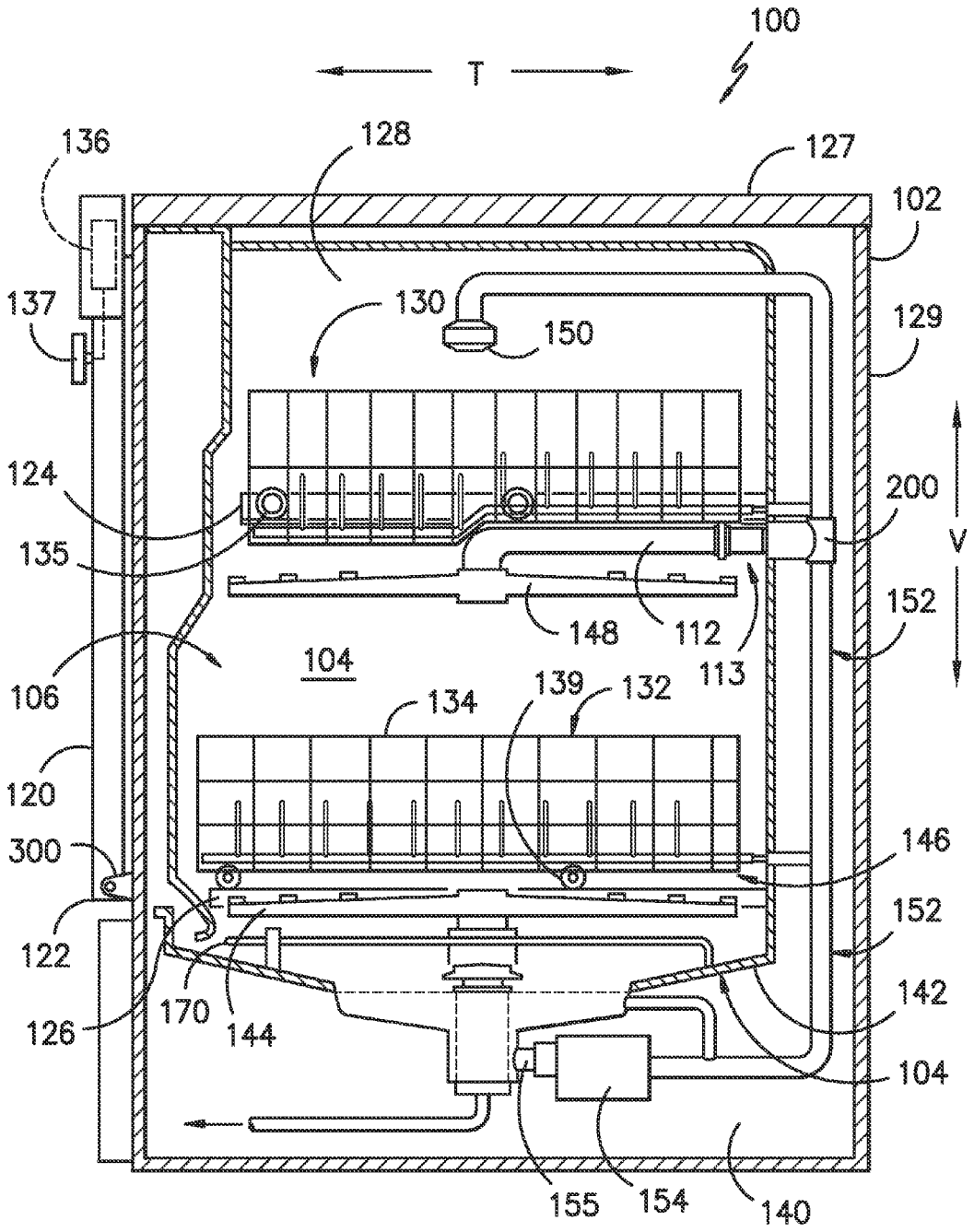
FIG. 2 is a cross-sectional view of the exemplary embodiment of a dishwashing appliance shown in FIG. 1 and hinge.

FIGS. 1 and 2 depict an exemplary domestic dishwasher 100 that may be configured in accordance with aspects of the present disclosure. Lateral direction L, transverse direction T, and vertical direction V are shown in the figures. For the particular embodiment of FIGS. 1 and 2, the dishwasher 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operations, and a horizontal open position for loading and unloading of articles from the dishwasher. Latch 156 is used to lock and unlock door 120 for access to wash chamber 106. The cabinet 102 includes a pair of opposing side walls 128, a top wall 127, and a rear wall 129. A tub 104 is disposed inside the cabinet 102 and configured with a front opening for receipt of a door 120 hinged at its bottom 122.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown), in which the rack is substantially positioned outside the wash chamber 106, and a retracted position (shown in FIGS. 1 and 2), in which the rack is located inside the wash chamber 106. This rack movement is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130. Although a spray assembly 150 is shown, an upper spray arm assembly may be used as well. Other fluid emitting devices for cleaning articles may be used at the lower, middle, and/or upper positions as well.

The lower and mid-level spray-arm assemblies 144, 148 and the upper spray assembly 150 are in fluid communication with a pump 154 and a main supply conduit 152 for circulating fluids (e.g., wash or rinse) in the tub 104. The main supply conduit 152 is served by a recirculation pump 154 positioned in a machinery compartment 140 located below the tub sump portion 142 (i.e., bottom wall) of the tub 104, as generally recognized in the art. Pump 154 receives fluid from sump 142 to provide a flow to the main supply conduit 152. A heating element 170 can be used to provide heat during e.g., a drying cycle.

Each spray-arm assembly 144, 148 includes an arrangement of discharge ports or orifices for directing washing fluid received from pump 154 onto dishes or other articles located in rack assemblies 130 and 132. The arrangement of the discharge ports in spray-arm assemblies 144, 148 provides a rotational force by virtue of washing fluid flowing through the discharge ports. The resultant rotation of the spray-arm assemblies 144, 148 and the operation of spray assembly 150 using fluid from pump 154 provides coverage of dishes and other dishwasher contents with a washing spray. Other configurations of spray assemblies may be used as well.

The middle spray-arm assembly 148 is releasably connected with fluid supply conduit 152 by way of a diverter 200 as further described herein. Specifically, as rack 130 is moved in and out of chamber 106, fluid supply conduit 112 releasably connects or disconnects from diverter 200. Other configurations may also be used.

The dishwasher 100 is further equipped with a controller 137 to regulate operation of the dishwasher 100. The controller may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, different spray devices and spray arm assemblies may be used, and other differences may be applied as well.

Figure 3:
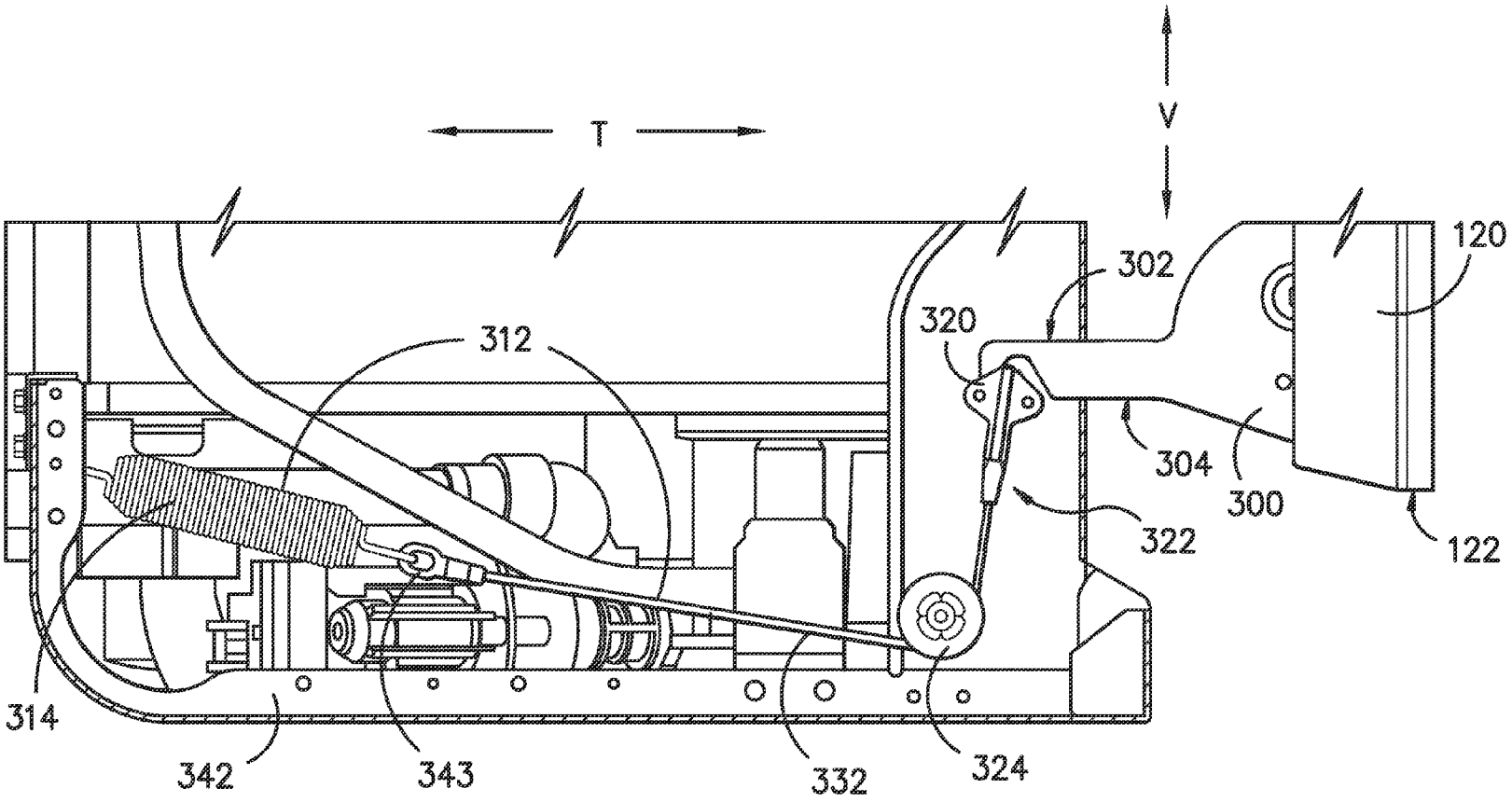
FIG. 3 is a side view of an exemplary spring linkage and one-piece hinge installed on a dishwasher frame.
Figure 4:
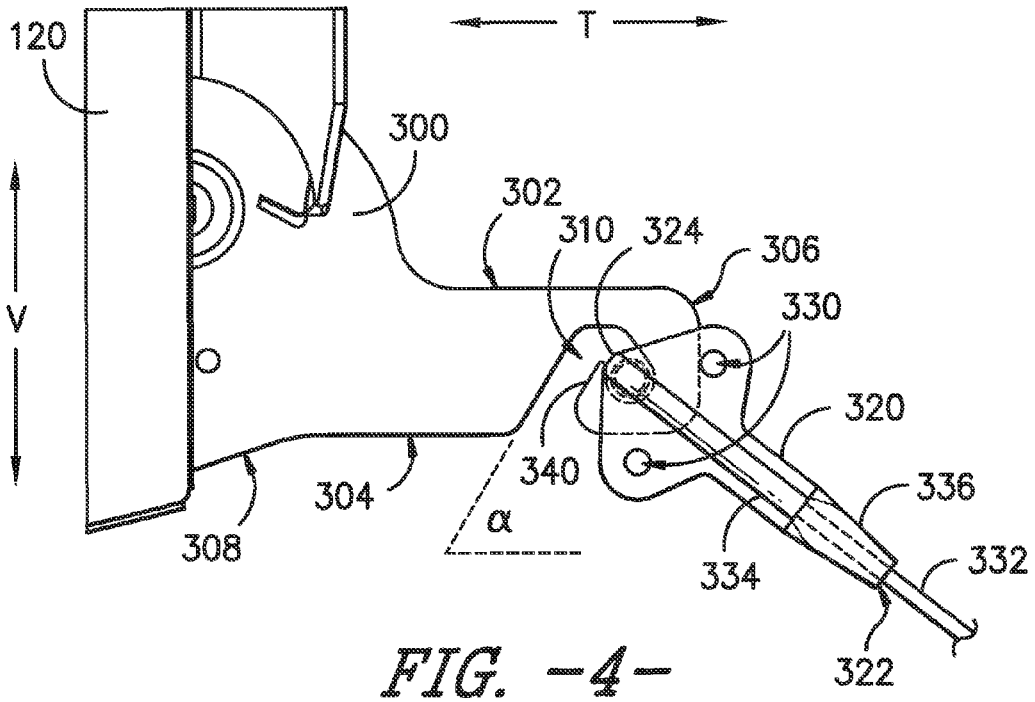
FIG. 4 is a side view of the exemplary hinge and clevis connection.
Figure 5:
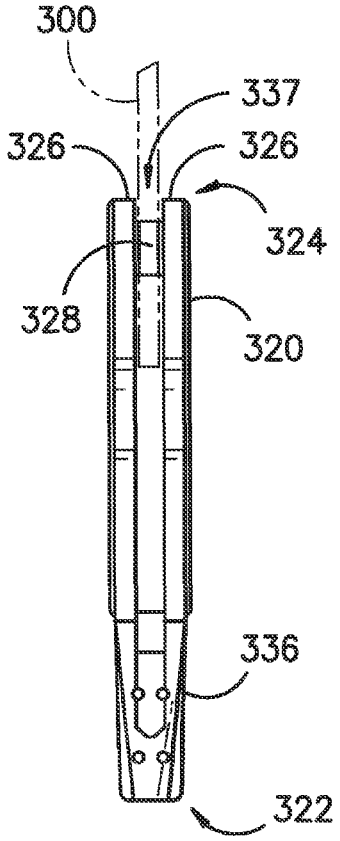
FIG. 5 is a top view of the exemplary clevis.

FIGS. 3, 4, and 5 show the door 120 with a pair of one-piece hinges 300 disposed proximate the opposing side walls 128 of cabinet 102. Each hinge 300 defines a top edge 302, bottom edge 304, hinge distal end 306, and hinge proximal end 308. The hinge proximal end 308 is removably coupled to the door 120.

Figure 9:
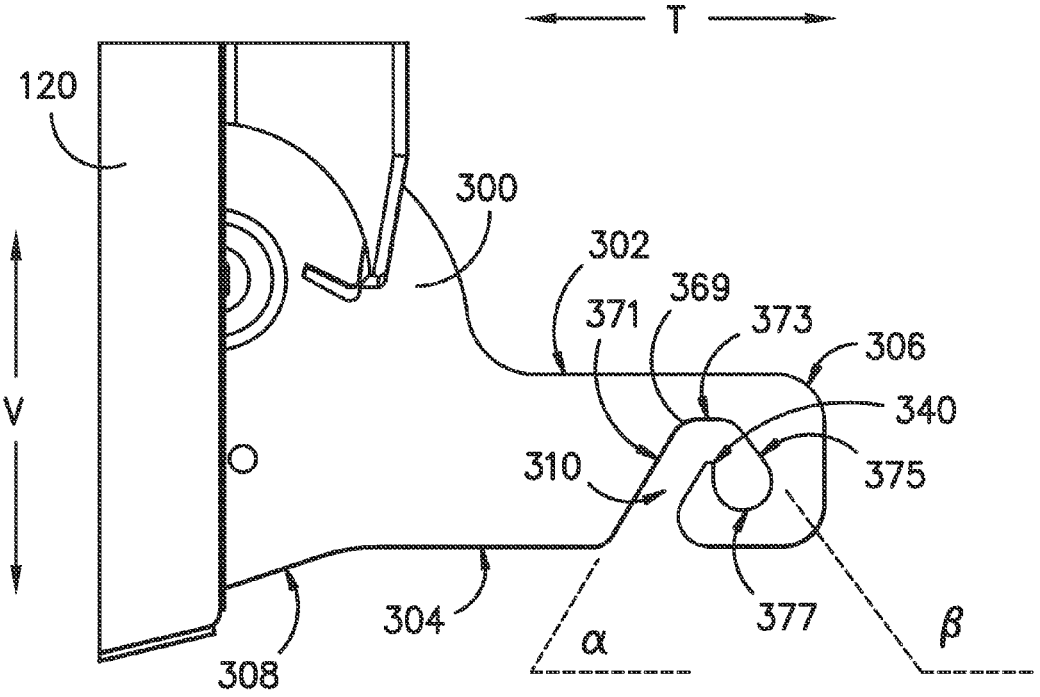
FIG. 9 is a side view of an exemplary hinge of the present invention.

The hinge distal end 306 is spaced apart along transverse direction T from hinge proximal end 308. The hinge distal end 306 defines an arched cutout 310 extending vertically upward from the bottom edge 304 and terminating near the hinge distal end 306. As shown in FIG. 9, for this exemplary embodiment, arched cutout 310 is defined by an edge 369 that includes a first section 371 at an angle $\alpha$ from transverse direction T, an adjacent second section 373 forming a flattened top apex 373 that is parallel to transverse direction T, an adjacent third section 375, and an adjacent curved or arcuate section 377 into which a pin 328 can be removably received. These sections provide a hook-like shape for cutout 310. A hinge retention lip 340 projects upwardly along vertical direction V and is positioned adjacent to arcuate section 377. In one exemplary embodiment, angle $\alpha$ may be e.g., in a range including 30 to 60 degrees and, in another exemplary embodiment, about 45 degrees. In one exemplary embodiment, angle $\beta$ may be e.g., in a range including 90 to 180 degrees and, in another exemplary embodiment, about 135 degrees.

Appliance 100 includes at least one spring linkage, shown as a pair of spring assemblies or spring linkages 312, positioned on each side 128 of cabinet 102. Only one side is shown in FIGS. 3, 4, 5, 7, and 8—it being understood the construction of each side is substantially similar. On each side of appliance 100, the spring linkage 312 has a clevis 320 removably coupled to the cutout 310 of the hinge 300.

For each side, the spring linkage 312 includes a cable 332 coupled to the clevis proximal end 322 using a conical cable mount 336. The conical cable mount 336 provides a hole of decreasing diameter to secure an end of cable 332. Spring linkage 312 includes a spring 314 removably coupled to a leg 342 of the dishwasher frame 342. A cable eyelet 343 is mounted to the cable 332 and coupled to the spring 314. Spring 314 applies tension to the cable 332, which in turn pulls on hinge 300 using clevis 320.

FIGS. 4 and 5 show the clevis 320 defining a clevis proximal end 322 and a clevis distal end 324. A pair of clevis legs 326 are positioned on opposing sides of the hinge 300 and form a slot 337 for receipt of hinge 300. Clevis legs 326 are positioned at clevis distal end 324 and extend from clevis distal end 324 towards the clevis proximal end 322. Each leg 326 of the clevis 300 has a rib 334 formed into the leg 326 for additional strength and to help guide a spring linkage removal tool (not shown) into position. For this exemplary embodiment, clevis 300 is symmetrical about rib 334.

A clevis connecting pin 328 (FIG. 5) is disposed between the pair of legs 326 at the clevis distal end 324 and within slot 337. Each clevis leg 326 has at least one tool bore 330 for complementary receipt of a linkage removal tool. For this exemplary embodiment, each clevis leg 326 includes a pair of tool bores 330 positioned in an opposing manner about rib 334 so as to provide a total of four tool bores 330.

Figure 6:
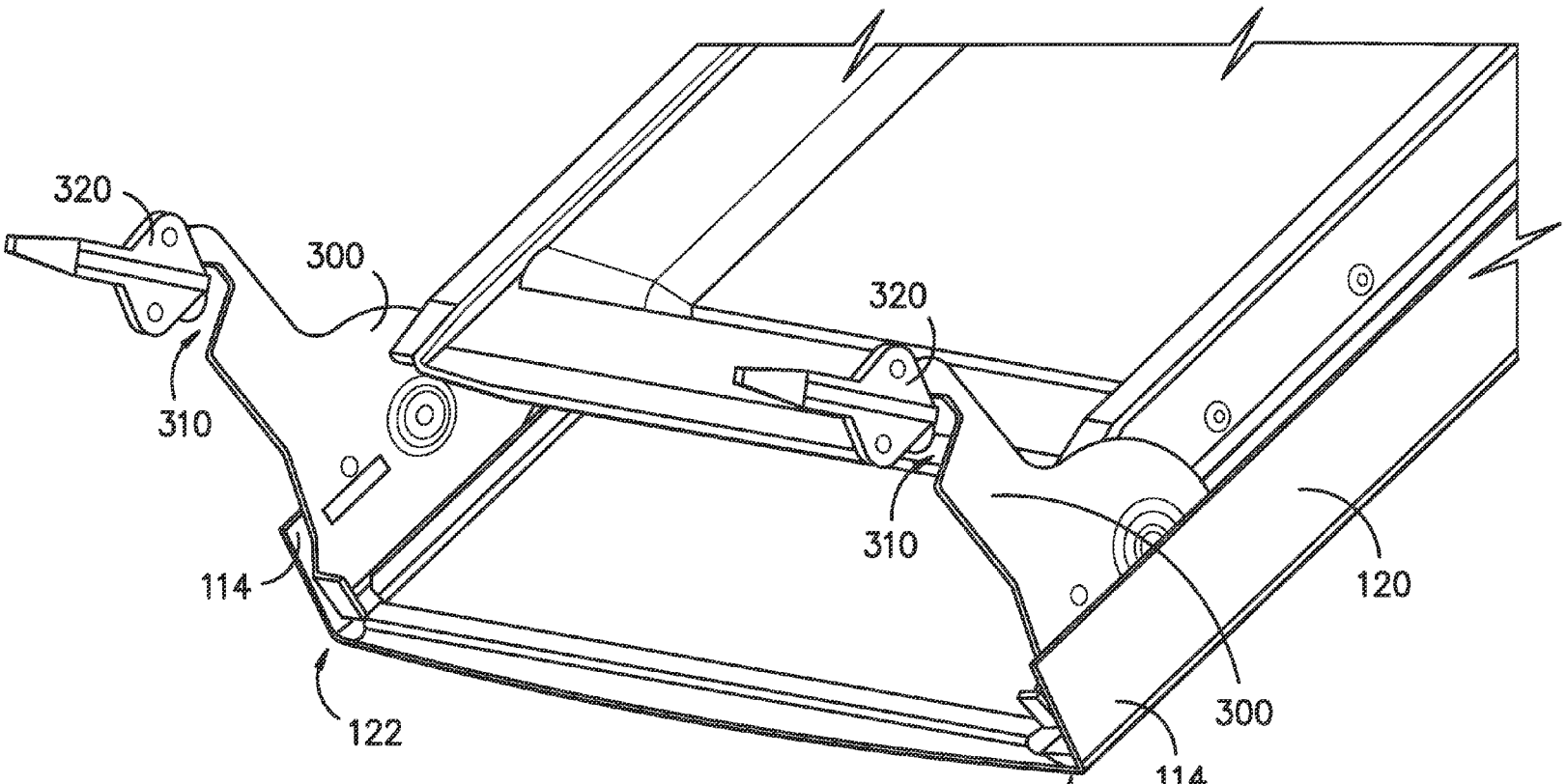
FIG. 6 is a perspective of a dishwasher door showing exemplary hinges of the present invention.
Figure 7:
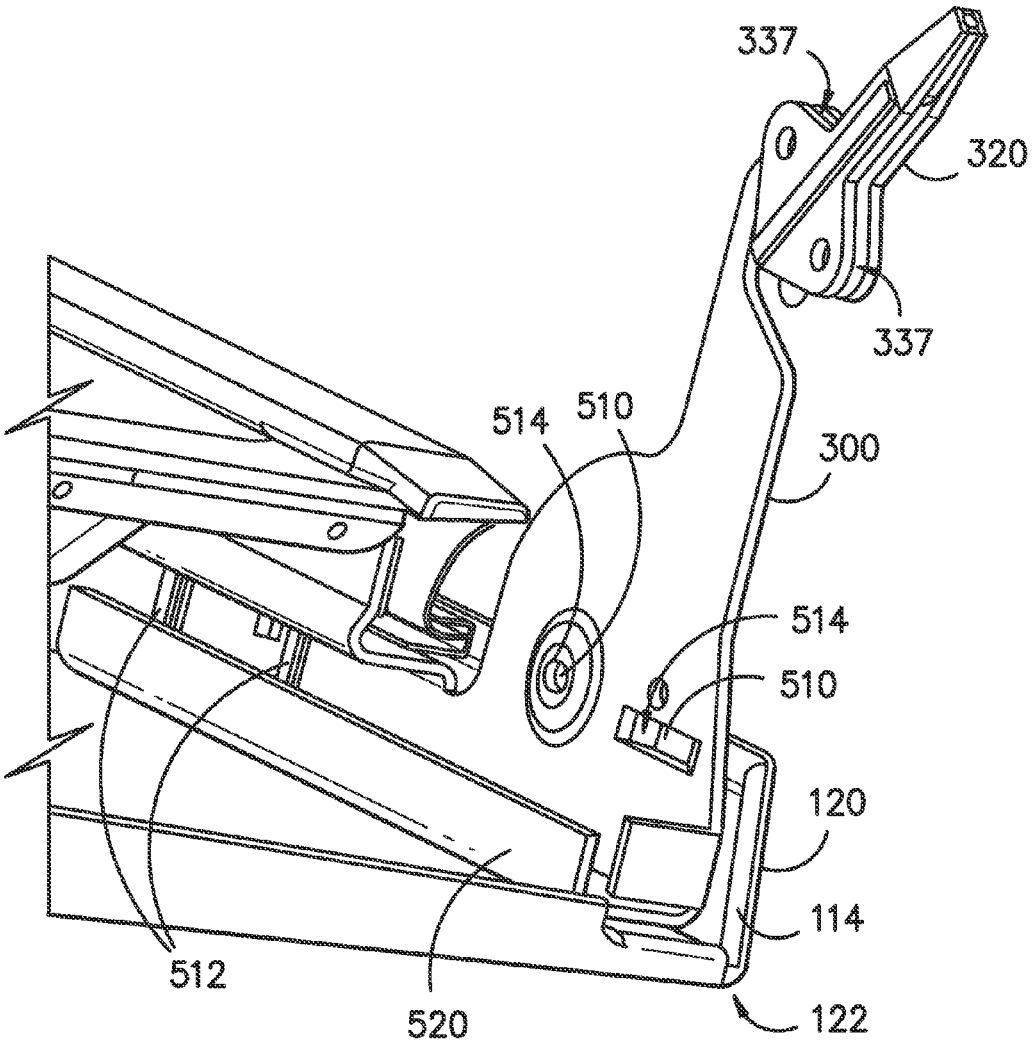
FIG. 7 is a perspective of the exemplary hinge mounted to a dishwasher door.

Referring to FIGS. 6 and 7, on each door lateral side 114, door 120 includes a channel 520 into which hinge 300 is positioned and removably attached to door 120. Door 120 includes at least one retaining clip 512 for removably coupling the hinge 300 to the channel 520. The door 120 has at least one mounting anchor 510 in the door lateral sides 114 for aligning and maintaining the hinge 300 in position. The hinge 300 has at least one anchor slot 514 for complementary receipt of the at least one mounting anchor 510.

Figure 8:
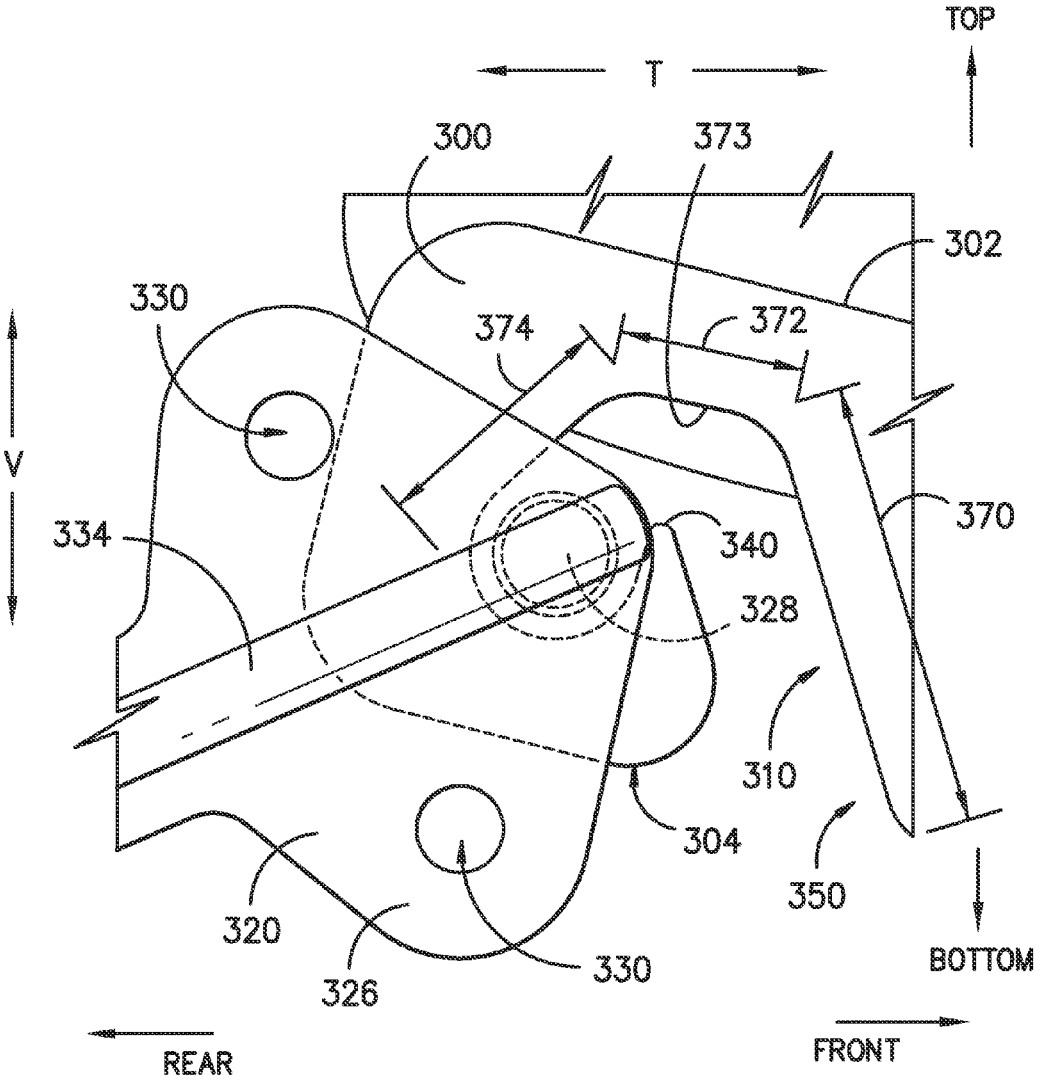
FIG. 8 is a close-up side view of various features of the exemplary hinge and clevis connection of the present invention.

FIG. 8 shows the hinge 300 with a hinge retention lip 340 projecting towards the second section 373 for retaining the clevis connection pin 328 in an engaged position while the door 120 is opened and closed. The arched cutout 310 is oriented with the entrance on the bottom edge 304. The arched cutout 310 extends from the bottom edge 304 of the hinge 300 to enable servicing from below without removing the dishwasher from the installed position (in-situ). A linkage removal tool (not shown) gains access to the clevis 320 from the front of the dishwasher after removal of the dishwasher toekick panel.

Specific features of the arched cutout 310, as shown in FIG. 8, enable front access in-situ removal of the spring linkage 312 from the door hinges 300 thereby allowing in-situ removal of the door. An enlarged entrance 350 at the bottom edge 304 of the hinge 300, a linear second section 373 positioned near the top edge 302, and a hinge retention lip 340 allow sufficient space for the clevis connecting pin 328 to easily travel in and out of the arched cutout 310 while also retaining the clevis 320 engaged with the hinge 300 during opening and closing of the door 120.

For this exemplary embodiment, the arched cutout 310 is formed such that the clevis connecting pin 328 moves in three linked travel paths for engagement and disengagement with the hinge 300. The first path 370 starts at the enlarged entrance 350 and extends upward in the first angle $\alpha$ direction toward the rear wall 129. The second path 372 extends in a generally traverse direction sufficient distance such that the clevis connecting pin 328 clears the pin retention lip 340. The third path 374 extends downward along second angle $\beta$ direction toward the rear wall 129. These linked travel paths provide serviceable geometry to retain the clevis pin 328 connection with the hinge 300 during normal door 120 operation while also allowing a linkage removal tool (not shown) to disengage the clevis 320 from the hinge 300 for in-situ door 120 removal. As shown, these three paths are at non-zero angles to each other.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a cabinet defining a wash chamber for the receipt of articles for washing, the cabinet comprising a pair of opposing side walls, a top wall, and a rear wall;

a tub disposed inside the cabinet and configured with a front opening;

a door positioned at the front opening and hinged at a bottom of the door;

a pair of one-piece hinges supported on the door near the bottom and disposed proximate the opposing side walls of the cabinet, each hinge defining a top edge, bottom edge, hinge distal end, and hinge proximal end, the hinge proximal end removably coupled to the door, the hinge distal end defining an arched cutout extending from an enlarged entrance at the bottom edge toward the front opening, the arched cutout terminating near the hinge distal end; and at least one spring linkage, each spring linkage attached to one of the hinges, each spring linkage comprising a clevis removably coupled to the cutout, the clevis defining a clevis proximal end and a clevis distal end, the clevis further comprising a pair of legs positioned on opposing sides of the hinge and extending from the clevis distal end towards the clevis proximal end, and a clevis connecting pin disposed between the pair of legs at the clevis distal end, each clevis leg further comprising at least one tool bore configured for complementary receipt of a linkage removal tool.

2. A dishwashing appliance as in claim 1, wherein the arched cutout further comprises a flattened top apex.

3. A dishwashing appliance as in claim 1, wherein the hinge further comprises a hinge retention lip.

4. A dishwashing appliance as in claim 1, wherein the arched cutout further comprises at least three linked travel paths, said travel paths comprising a first travel path, a second travel path, and a third travel path that are at angles with respect to each other.

5. A dishwashing appliance as in claim 4, wherein the first travel path extends upward in a first angle α direction.

6. A dishwashing appliance as in claim 5, wherein the first angle α is approximately between 30 degrees and 60 degrees.

7. A dishwashing appliance as in claim 4, wherein the second travel path extends in a transverse direction.

8. A dishwashing appliance as in claim 4, wherein the third travel path extends downward in along a second angle β direction.

9. A dishwashing appliance as in claim 8, wherein the second angle β is approximately between 90 degrees and 180 degrees.

10. A dishwashing appliance door hinge assembly, comprising:

a pair of one-piece hinges supported near the bottom of a dishwasher door, each hinge defining a top edge, bottom edge, hinge distal end, and hinge proximal end, the hinge proximal end removably coupled to the door, the hinge distal end defining an arched cutout extending upward from an enlarged entrance at the bottom edge and angled away from the dishwasher door, the arched cutout terminating near the hinge distal end;

at least one spring linkage, each spring linkage attached to one of the hinges, each spring linkage comprising;

a clevis removably coupled to the cutout, the clevis defining a clevis proximal end and a clevis distal end, the clevis further comprising a pair of legs positioned on opposing sides of the hinge and extending from the clevis distal end towards the clevis proximal end; and a clevis connecting pin disposed between the pair of legs at the clevis distal end, each clevis leg further comprising at least one tool bore configured for complementary receipt of a linkage removal tool.

11. A dishwashing appliance door hinge assembly as in claim 10, wherein the arched cutout further comprises a flattened top apex.

12. A dishwashing appliance door hinge assembly as in claim 10, wherein the hinge further comprises a hinge retention lip.

13. A dishwashing appliance door hinge assembly as in claim 10, wherein the arched cutout further comprises at least three linked travel paths, said travel paths comprising a first travel path, a second travel path, and a third travel path.

14. A dishwashing appliance door hinge assembly as in claim 13, wherein the first travel path extends upward in a first angle α direction.

15. A dishwashing appliance door hinge assembly as in claim 14, wherein the first angle α is approximately between 30 degrees and 60 degrees.

16. A dishwashing appliance door hinge assembly as in claim 13, wherein the second travel path extends in a transverse direction.

17. A dishwashing appliance door hinge assembly as in claim 13, wherein the third travel path extends downward in a second angle β direction.

18. A dishwashing appliance door hinge assembly as in claim 17, wherein the second angle β is approximately between 90 degrees and 180 degrees.

19. A dishwashing appliance, comprising:

a cabinet defining a wash chamber for the receipt of articles for washing, the cabinet comprising a pair of opposing side walls, a top wall, and a rear wall;

a tub disposed inside the cabinet and configured with a front opening;

a door positioned at the front opening and hinged at a bottom of the door;

a pair of one-piece hinges supported on the door near the bottom and disposed proximate the opposing side walls of the cabinet, each hinge defining a top edge, bottom edge, hinge distal end, hinge proximal end, and a hinge retention lip, the hinge proximal end removably coupled to the door, the hinge distal end defining an arched cutout extending upward from an enlarged entrance at the bottom edge toward the front opening, the arched cutout terminating near the hinge distal end; and at least one spring linkage, each spring linkage attached to one of the hinges, each spring linkage comprising a clevis removably coupled to the cutout, the clevis defining a clevis proximal end and a clevis distal end, the clevis further comprising a pair of legs positioned on opposing sides of the hinge and extending from the clevis distal end towards the clevis proximal end, and a clevis connecting pin disposed between the pair of legs at the clevis distal end, each clevis leg further comprising at least one tool bore configured for complementary receipt of a linkage removal tool, wherein the arched cutout further comprises at least three linked travel paths extending between the enlarged entrance and the hinge retention lip, said travel paths comprising a first travel path, second travel path, and third travel path, each of the travel paths being at angles with respect to each other, wherein the first travel path extends upward from the enlarged entrance at a first angle α between 30 degrees and 60 degrees, wherein the second travel path extends in a transverse direction from the first travel path, and wherein the third travel path extends downward from the second travel path at a second angle β between 90 degrees and 180 degrees.

* * * * *